US007108451B2

(12) United States Patent
Ewer et al.

(10) Patent No.: US 7,108,451 B2
(45) Date of Patent: Sep. 19, 2006

(54) ROTATING CONCRETE FINISHING TROWEL

(76) Inventors: Charles J. Ewer, 27113 State Hwy. 27, Holcomb, WI (US) 54745; William T. Niznik, 1263 W. St., Lublin, WI (US) 54447

( * ) Notice: Subject to any disclaimer, the term of this patent is extended or adjusted under 35 U.S.C. 154(b) by 0 days.

(21) Appl. No.: 11/128,348

(22) Filed: May 13, 2005

(65) Prior Publication Data

US 2005/0254897 A1 Nov. 17, 2005

Related U.S. Application Data

(63) Continuation-in-part of application No. 10/846,398, filed on May 14, 2004, now Pat. No. 7,018,132.

(51) Int. Cl.
*E01C 19/22* (2006.01)

(52) U.S. Cl. ..... 404/112

(58) Field of Classification Search ..... 404/112, 404/118

See application file for complete search history.

(56) References Cited

U.S. PATENT DOCUMENTS

| | | | | |
|---|---|---|---|---|
| 2,289,248 A | | 7/1942 | Davis | 94/24 |
| 2,342,445 A | | 2/1944 | Allen | 94/45 |
| 2,556,983 A | | 6/1951 | Root | 94/45 |
| 2,605,683 A | | 8/1952 | Boulton | 94/45 |
| 2,621,568 A | | 12/1952 | Fletcher | 94/45 |
| 2,667,824 A | | 2/1954 | McCrery | 94/45 |
| 2,689,507 A | | 9/1954 | McCrery | 94/45 |
| 2,759,305 A | | 8/1956 | Helbig | 51/170 |
| 2,836,056 A | | 5/1958 | Drummond | 72/136 |
| 3,781,991 A | * | 1/1974 | Stretton et al. | 30/276 |
| 5,221,156 A | * | 6/1993 | Martin | 404/97 |
| 5,375,942 A | | 12/1994 | Lindley | 404/97 |
| 5,857,803 A | * | 1/1999 | Davis et al. | 404/102 |
| 5,984,571 A | * | 11/1999 | Owens | 404/97 |
| 6,200,065 B1 | * | 3/2001 | Eitzen | 404/114 |
| 6,516,598 B1 | * | 2/2003 | Notaras et al. | 56/16.7 |

(Continued)

OTHER PUBLICATIONS

U.S. Appl. No. 10/846,398 Ewer et al. filed May 17, 2004.

*Primary Examiner*—Gary S. Hartmann
(74) *Attorney, Agent, or Firm*—James V. Harmon

(57) ABSTRACT

A rotary cement or concrete finishing trowel has an operating head at one end of the apparatus that includes at least one cement finishing blade rotatably mounted for movement in a horizontal plane for smoothing a concrete floor surface. A drive motor, e.g., a 2-cycle gas engine, is provided at the other end of the apparatus. An elongated frame element is connected between the motor framework and the operating head and is preferably rigidly connected between them. A drive shaft extends diagonally between the motor and the operating head for imparting rotation to the finishing blade. The elongated frame element can be a tubular housing that surrounds the drive shaft and is connected at one end to the motor framework and at the other end is connected to the operating head so that the operator is able to use the frame element as a handle for lifting the entire apparatus over obstructions during operation as the weight of the motor at least partially counterbalances the weight of the operating head. A pivot is also provided to permit the handle to be raised or lowered while allowing limited free up or down movement of the handle through a controlled arc. Provision is made for resisting torque produced by blade movement and for rotating each finishing blade about a radial axis in discrete incremental steps.

13 Claims, 10 Drawing Sheets

U.S. PATENT DOCUMENTS

D472,248 S 3/2003 Riess ..... 15/3
6,637,974 B1 10/2003 Glenn ..... 404/112
7,018,132 B1 * 3/2006 Ewer et al. ..... 404/112

* cited by examiner

ROTATING CONCRETE FINISHING TROWEL

This application is a continuation-in-part of application Ser. No. 10/846,398 filed May 14, 2004 now U.S. Pat. No. 7,018,132 and bearing the same title.

FIELD OF THE INVENTION

This invention relates to concrete finishing and more particularly to a motor-driven rotating finishing trowel for concrete.

BACKGROUND OF THE INVENTION

Rotating concrete finishing machines currently in use are relatively heavy, often weighing over 65 pounds, are usually difficult to maneuver and are expensive to produce. Because of their bulk and weight distribution, prior devices are awkward to handle and virtually impossible to lift while in operation any more than it would be possible to lift a wheelbarrow by its handles. This makes it hard to clear objects or to place the machine in restricted spaces such as in closets, under stairways or behind pipes. In addition, because of the way they are constructed, it is difficult or impossible to finish the concrete all the way to each wall of a room. Instead, it is considered normal for current equipment to leave a 3" or 4" gap of unfinished concrete next to the wall so that the cement worker must put on kneeboards so that he can hand trowel the unfinished area next to the wall around the entire room. In U.S. Pat. No. 2,342,445, which is typical, the troweling blades are spaced centrally 2" or so from the ring guard 34 as shown in FIG. 2 and in U.S. Pat. No. 2,605,683 the blade 19 is spaced centrally from the guard ring 3 (FIG. 2). Likewise in patent D 472,248 the blades are shown spaced centrally from the guard in FIG. 4 and U.S. Pat. No. 6,637,974 provides wall roller guards that keep the blades away from the wall.

In view of these and other deficiencies of the prior art, it is one object of the invention to find a way of building a concrete finishing machine so that while in operation it can clear obstructions such as pipes or door sills and easily get over other objects that are connected to the floor as well as around them while the machine is in operation.

Another more specific object of the invention is to provide a concrete finishing machine that will finish concrete all the way to each wall of a room and can be easily maneuvered around pipes and into small spaces and corners.

Another object of the invention is to provide a concrete finishing machine that will provide a total floor finish without the requirement for hand finishing next to walls and in corners.

Another object of the invention is to provide an improved concrete finishing machine that is smaller and lighter than prior equipment and is able by making possible an operating head with a low profile to get under objects such as stairways, readily maneuvered around pipes, easily lifted manually over objects that project upwardly from the floor and placed in restricted areas such as closets.

Another object is to find a way to reduce operator fatigue and to accommodate operators of different stature.

A further specific object of the invention is to provide a rotating concrete finishing machine that is balanced in a way that enables it to be easily lifted by hand, is rugged in construction, reliable in operation, can be produced at low cost and has a motive power unit that can be supported by the operator during use.

These and other more detailed and specific objects of the present invention will be better understood by reference to the following figures and detailed description which illustrate by way of example but a few of the various forms of the invention within the scope of the appended claims.

THE FIGURES

SUMMARY OF THE INVENTION

The invention is used for finishing concrete in various forms, sometimes referred to by the misnomer "cement" which is a component of concrete. The invention provides a power operated rotating concrete finishing trowel having an operating head at one end of the apparatus that includes at least one concrete finishing blade rotatably mounted thereon. A drive motor, e.g., a 2-cycle gas engine, is provided at the other end of the apparatus. An elongated frame element is connected between the motor and the operating head. A drive shaft extends between the motor and the operating head for imparting rotation to the finishing blade. In a preferred form of the invention, the elongated frame element is a tubular housing that surrounds the drive shaft and is connected at one end to the motor framework and at the other end is connected to the operating head so that a center portion of the frame element can be used as a handle for lifting the machine over obstructions as the weight of the motor at least partially counterbalances the weight of the operating head. The term "concrete" herein is used broadly to include various compositions that employ portland cement or simply cement as a binding matrix.

DETAILED DESCRIPTION OF THE INVENTION

Figure 1:
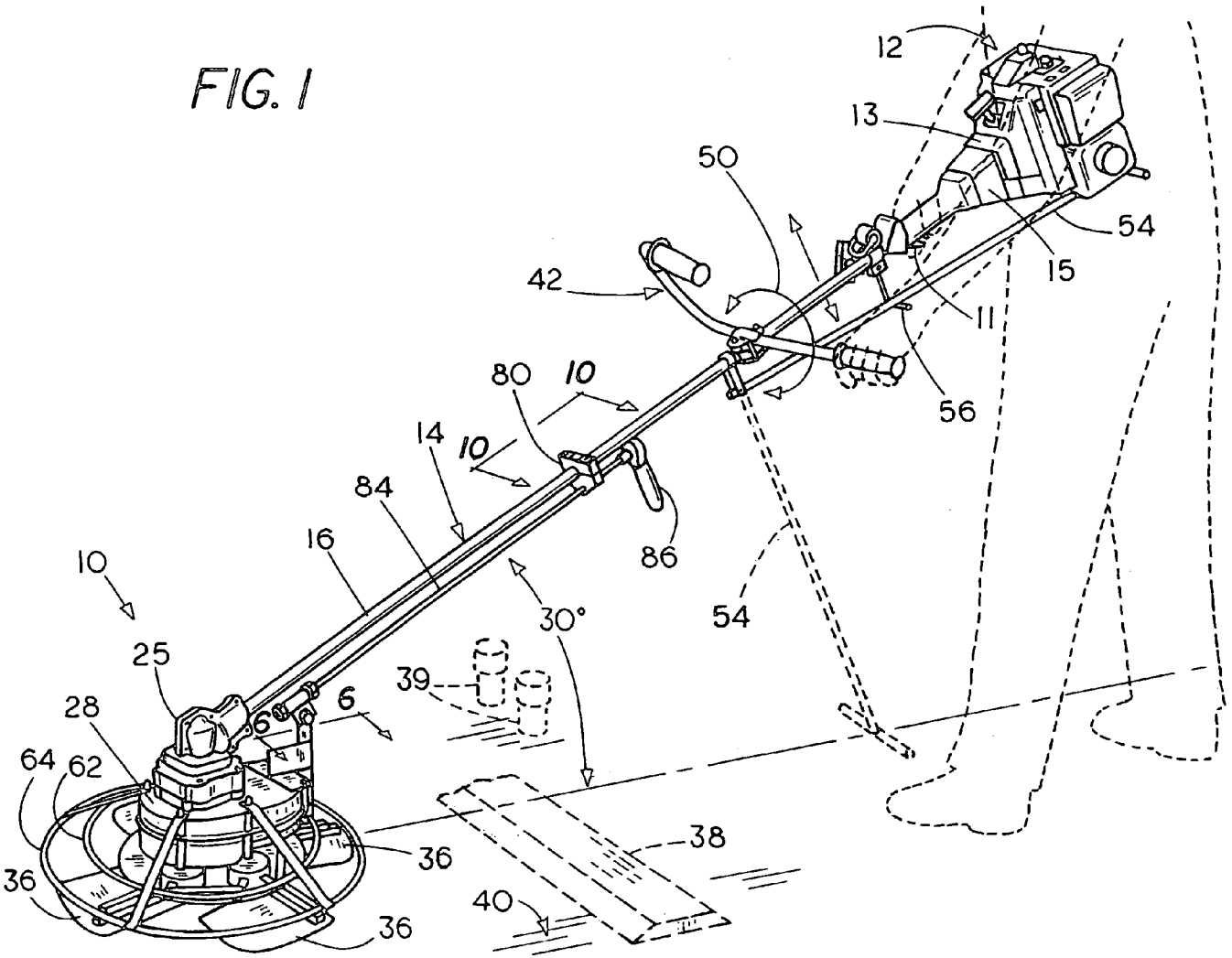
FIG. 1 is a perspective view of the invention during use.

As shown in FIG. 1, the invention provides a rotating concrete finishing trowel for surfacing concrete or "cement" that includes an operating head 10 at one end, a drive motor 12 at the opposite end and an elongated connecting frame element 14 rigidly connected between the framework 15 of the motor 12 and the operating head 10. In a preferred embodiment, the motor 12 is typically a 1.5 horsepower, 2 cycle 25 cc gas engine of suitable known commercially available construction having a self-contained centrifugal clutch 13 or if desired an electric motor using either batteries or standard electrical power. The connecting element in the embodiment shown preferably comprises a tubular housing 16 (FIG. 3) which encloses an elongated drive shaft 20, in this case a flexible drive shaft that is coupled through bevel gears 22 and 24 which are enclosed in a gear case 25, to an input shaft 26 of a speed reducer 28 that has a countershaft 30 driving an output shaft 32 which is rigidly connected to a rotating hub 34 upon which four horizontally disposed concrete finishing blades 36 are mounted so as to rotate during operation about a vertical axis for finishing a concrete or cement floor. The combined speed reduction of the bevel gears and gear box 28 can be about 30 to 1 so that the blades 36 typically rotate at about 60–130 rpm or 116 rpm at an engine speed of 3500 rpm. Engine speed is preferably controlled throughout operation by a hand throttle 11.

Figure 9:
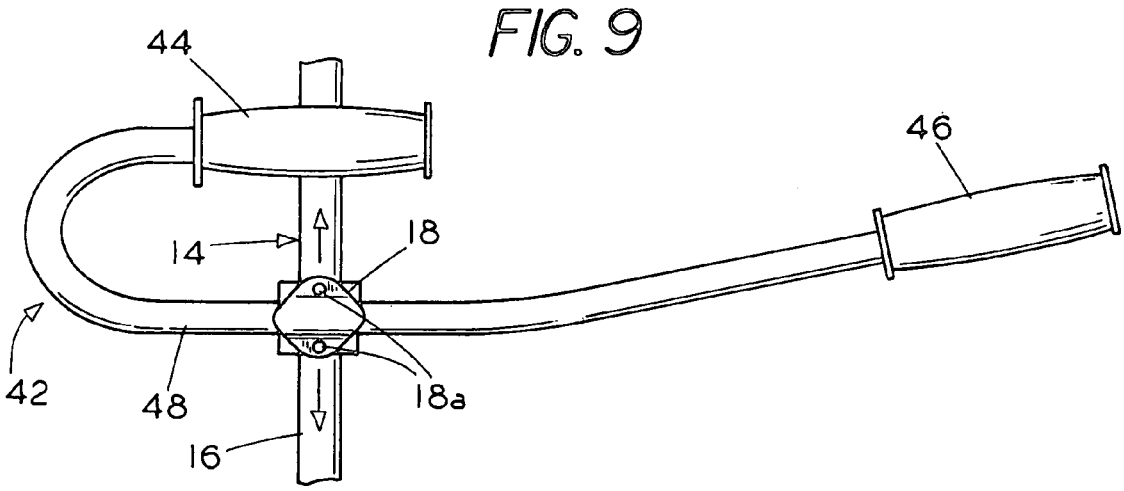
FIG. 9 is top view of the control handles used for maneuvering the invention shown on a larger scale than in FIG. 1.

The elongated connecting element or housing 16 can be used as a handle for manipulating the position of the operating head 10 as well as for lifting the operating head 10 over obstructions such as pipes 3*a* or a doorsill 38 resting on the floor 40. Housing 16 is set at an angle of 30° to the floor 40 (FIG. 1). Lifting of the operating head 10 and placing it to a new position can be accomplished easily with the present invention because the entire apparatus can be lifted from a point near the center of the connecting element 14 since the drive motor 12 partially counterbalances the weight of the operating head 10. In addition, precise positioning of the operating head during use can be easily achieved by means of a control handle or bar 42 (FIG. 9) which includes a pair of laterally spaced apart hand grips 44 and 46 that are secured to the ends of the handlebar 48 which is itself coupled to the tubular housing 16 by a releasable clamp 18 that allows the handle 42 to be moved up or down the tube 16 and locked in a selected position by tightening bolts 18*a*. The handgrip 44 can be positioned about 6" to 10" above the housing 16 and the grip 46 about 18" to 25" to one side. During operation, forward and rearward movement of the operating head 10 can be controlled by rotating the handle 42 about the axis of the housing 16 as shown by the arrow 50 while side-to-side motion of the operating head can be controlled by manually elevating or lowering of the housing 16 and motor 12. When the machine is not in use, the motor 12 and framework 14 can be supported on a stand 54. The stand 54 can be held in a raised position by means of a releasable hook 56.

The operating head 10 will now be described more fully by reference to FIG. 2.

Figure 11:
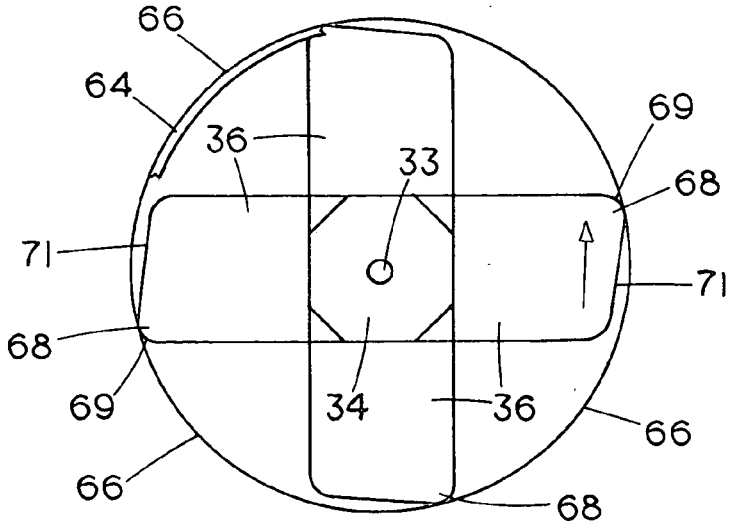
FIG. 11 is a diagrammatic plan view of the concrete finishing blades and guard ring of the invention on a larger scale than in FIG. 1.

Bolted to the gear case 28 is a safety shroud comprising radially extending diagonal bars 60 which are connected as by welding to circular ring elements 62 and 64 to enclose the blades 36 for safety purposes as they rotate. In addition, the ring 64 serves as a wall stop or guard ring. Its outer edge 66, e.g., 16" in diameter, is placed in direct alignment over the tip 68 of each of the blades 36 (FIGS. 1, 2 and 11). This enables the troweling blades 36 to finish a cement floor surface all the way to the wall or to a baseboard that is applied to the wall, i.e., to the edge of the floor leaving virtually no unfinished area that requires hand finishing. The invention, thus, is capable of finishing a larger area and eliminates hand finishing previously required around the edges of a room. The guard ring 64 is typically 16" in diameter.

Figure 2:
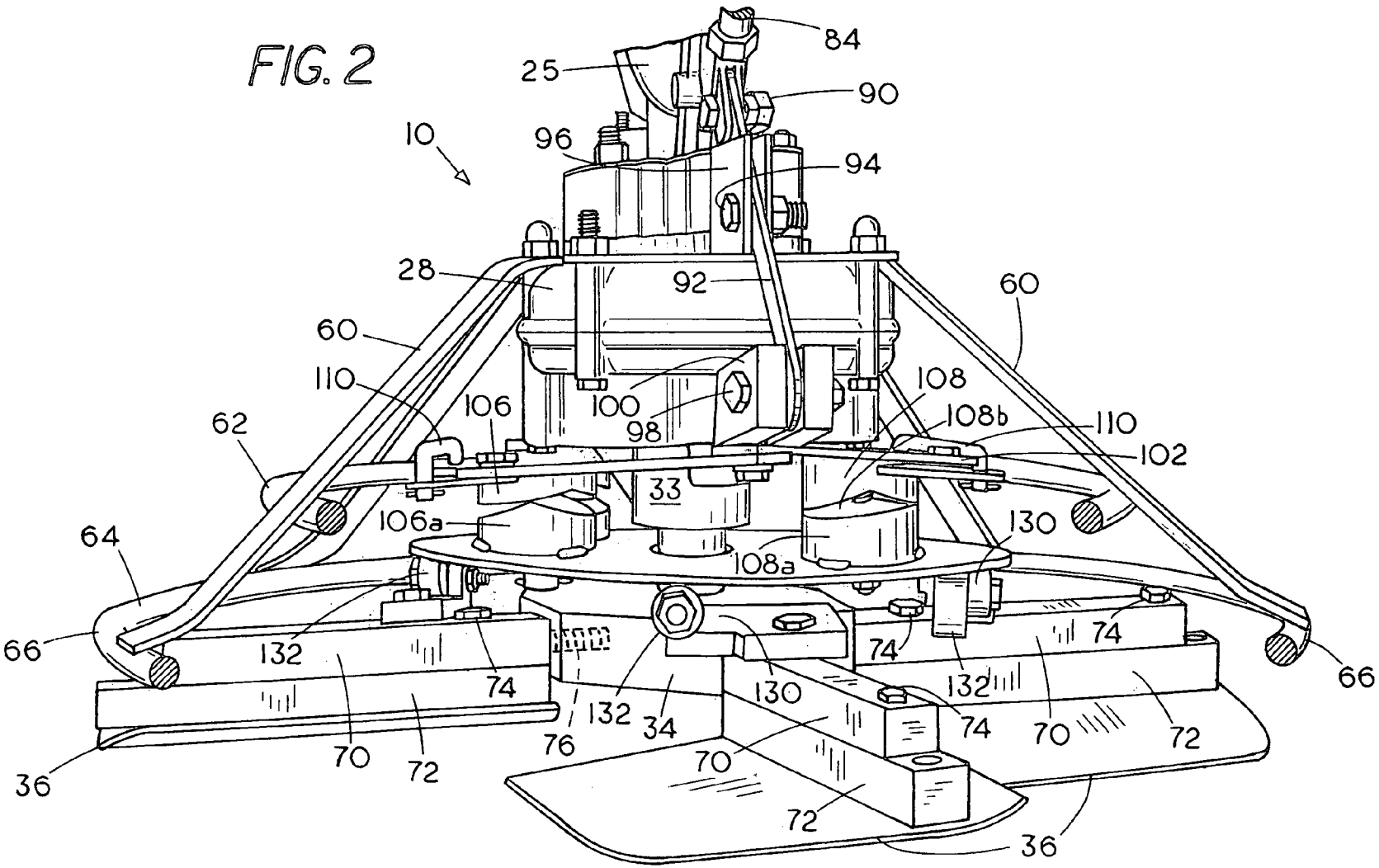
FIG. 2 is a rear end perspective view of the operating head of the invention partly broken away on a larger scale than in FIG. 1.
Figure 3:
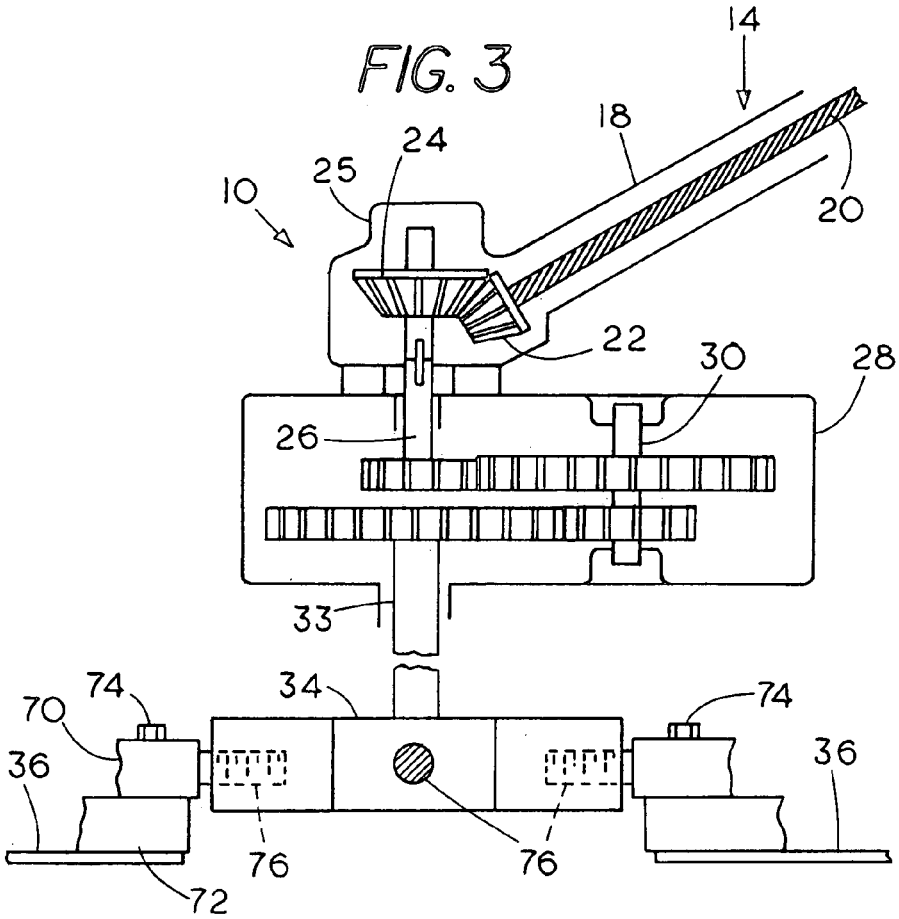
FIG. 3 is a diagrammatic vertical sectional view showing the transmission of power to the finishing blades.
Figure 4:
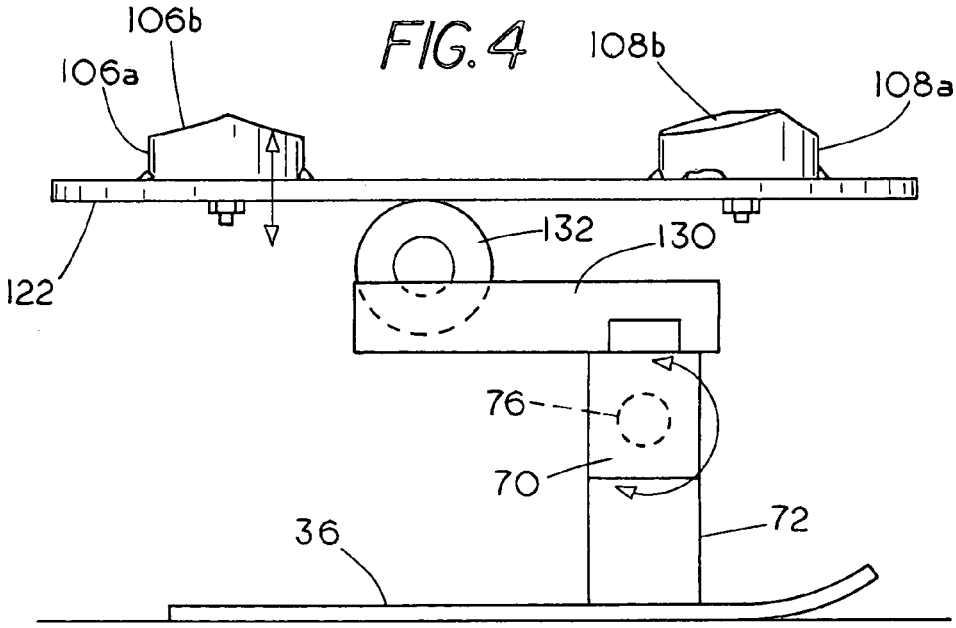
FIG. 4 is a diagrammatic side elevational view to show the pivotal mounting of the finishing blades.
Figure 5:
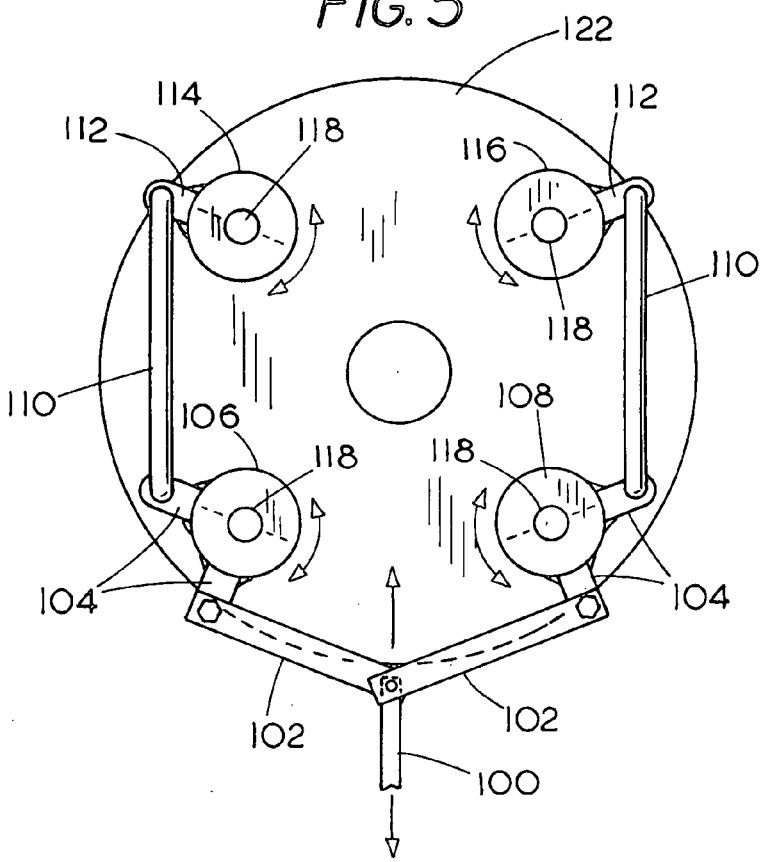
FIG. 5 is diagrammatic horizontal sectional view showing the blade pitch control mechanism.

In FIGS. 2 and 3 it can be seen that each of the blades 36 is supported on a pair of radially disposed arms 70 and 72 that are connected together, e.g., by bolts 74. Each of the upper arms 70 is mounted for rotation about a radial axis by the provision of a centrally extending threaded rod 76 connected to its inner end which is screw threaded into, but free to turn in the hub 34.

Figure 6:
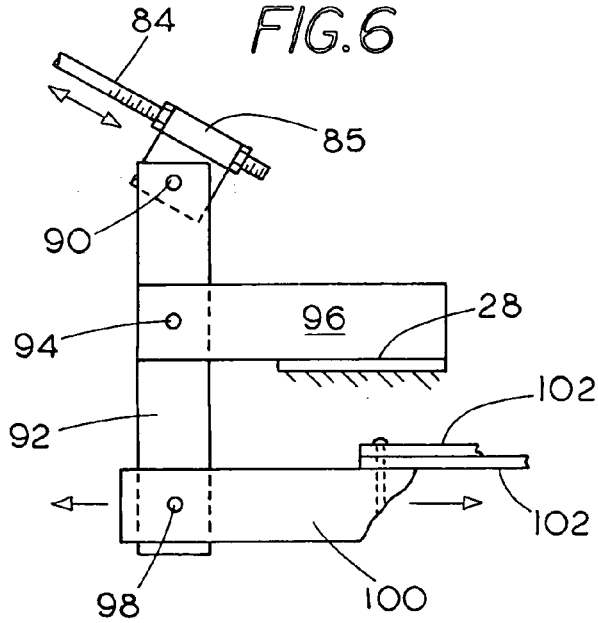
FIG. 6 is a partial side elevational view of blade pitch control links taken on line 6—6 on FIG. 1.
Figure 8:
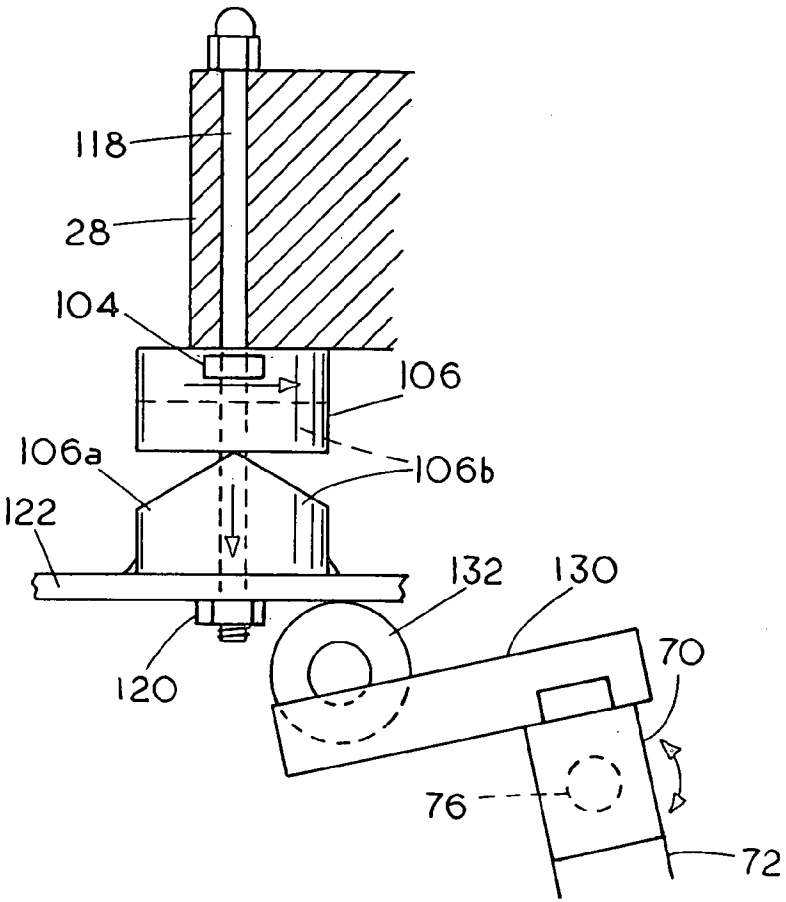
FIG. 8 is a view similar to FIG. 7 with a pitch change cam in its lowered position.
Figure 7:
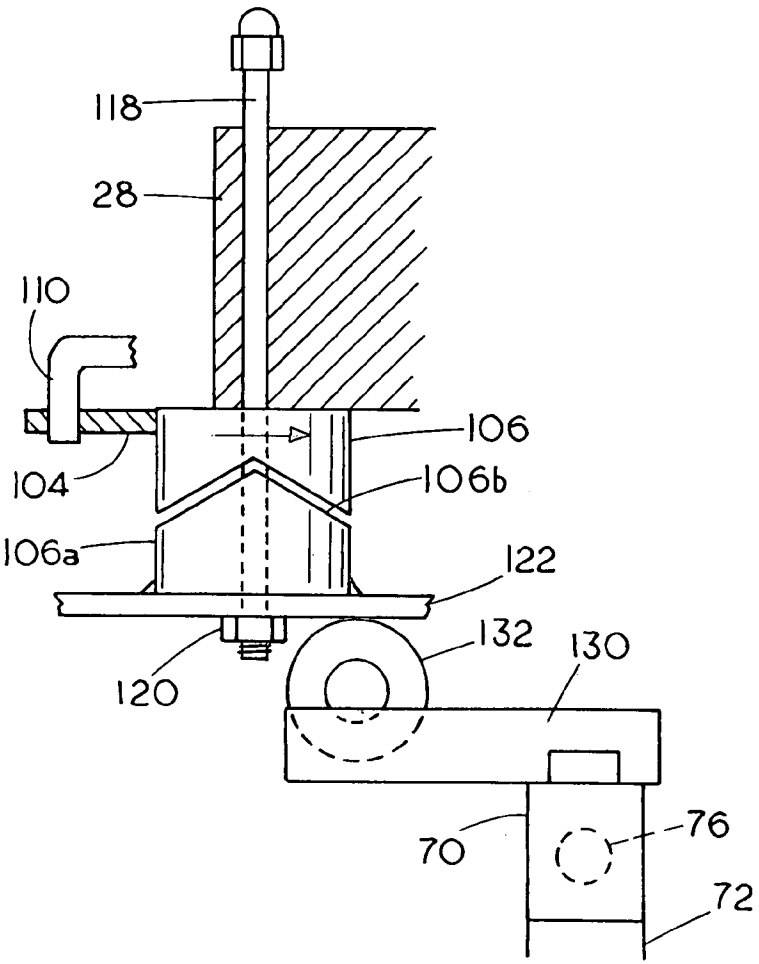
FIG. 7 is a diagrammatic view to show the operation of the blade pitch changing cams with a cam shown in its elevated position.
Figure 10:
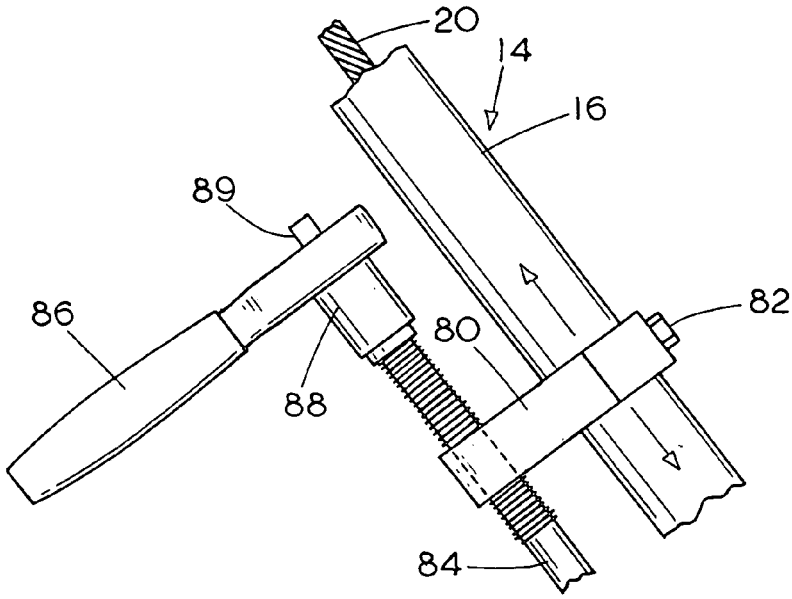
FIG. 10 is a partial side elevational view taken on line 10—10 of FIG. 1 on a larger scale than in FIG. 1.

The mechanism for changing the angular position or pitch of the blades 36 will now be described with reference to FIGS. 1, 2, 5–8 and 10. As shown in FIGS. 1 and 10, a support bracket 80 is clamped to the housing 16 by means of bolts 82 and can be moved up or down the housing 16 then by tightening bolts 82, locked in the desired position. Screw threaded through the bracket 80 is a positioning rod 84 having a positioning handle 86 at its upper end that is coupled to it by means of a reversible ratchet 88 similar to that on a reversible socket wrench for rotating the shaft 84 in either direction by turning a control lever 89. Thus, lever 89 controls the direction of rotation of the rod 84 when the handle 86 is moved. The movement of the control rod 84 acts through a leveling bracket 85 connected by pivot 90 to swing a link 92 about a pivot 94 which is connected rigidly to the gear housing 28 by a link 96. The leveling bracket 85 is bored to swivel freely on rod 84 and is held in place by a nut at each end (FIG. 6). The lower end of link 92 is in turn connected at 98 via a link 100 to two links or scissor arms 102 which are connected to arms 104 (FIG. 5) that are welded to rotary lifting cams 106 and 108 and in turn connected via links 110 to radial arms 112 which are welded to rotary lifting cams 114 and 116. The cams 106, 108, 114 and 116 are mounted for rotation on bolts 118 that are slideably mounted in the gear housing 28 and each is secured at its lower end by nut 120 to a circular positioning plate 122. Welded to the positioning plate 122 on the bolts 118 in alignment below the cams 106, 108, 114 and 116 are four similar cooperating cam members, only two of which, 106*a* and 108*a*, are shown in FIG. 2. In changing the blade pitch during operation, when the handle 86 is moved by the operator so as to screw the positioning rod 84 up or down in the bracket 80, the resulting pivotal movement of the link 92 will move the links 100, 102 and 110 in a given direction thereby rotating all of the upper cams 106, 108, 114 and 116 so that the rotating cams, acting through a sliding contact between mating cam surfaces, e.g., oblique surfaces 106*b* and 108*b* of the upper and lower four cams (FIGS. 7 and 8) lower the pitch control plate 122 as shown in FIG. 8 thereby lowering the free end of each of four control arms 130 through its contact with rollers 132 that are mounted on the free ends of arms 130 so as to tilt the blades 36 counter-clockwise thereby setting them at the desired pitch angle to achieve the proper finish for the cement or concrete floor that is being surfaced. The pitch of the mating cam surfaces is 30° to the horizontal.

Refer now to FIG. 11. While the precise shape of the outer edge of each blade 36 can be varied, excellent results have been achieved by rounding each leading edge at 69 and providing a taper that extends centrally at a small angle, as shown, proceeding at 71 toward the trailing edge of each blade. The tip 68 of each blade as already mentioned is aligned directly beneath the outer edge 66 of the guard ring 64.

Figure 12:
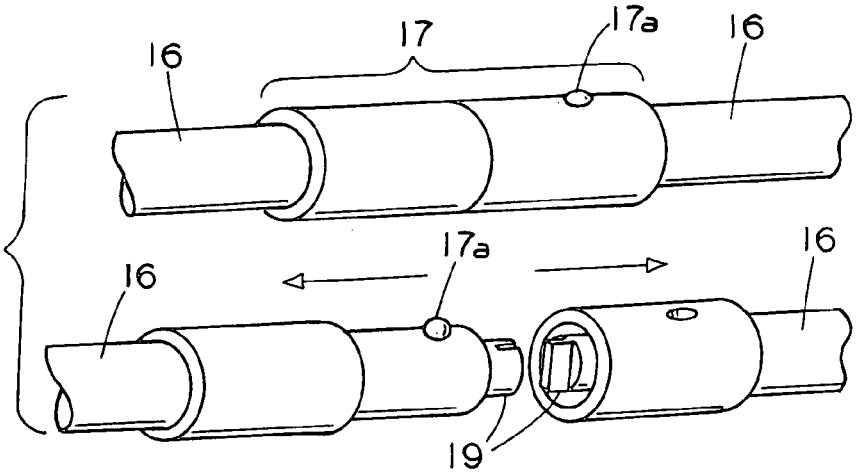
FIG. 12 is a perspective view of an optional separable drive shaft coupling that can be coupled for lengthening the handle or separated for removing the engine and FIG. 13 is a perspective view of an optional finishing pan that can be attached to the blades when desired.

Optionally, as shown in FIG. 12, the shaft housing 16 can be provided if desired with a separable coupling 17 that is secured together when coupled by a detent 17*a* to allow the invention to be collapsed for storage or transport. The drive shaft 20 in that case is suitably connected, e.g., by means of a tongue and groove connection 19 which fits together when the coupling is assembled.

Figure 13:
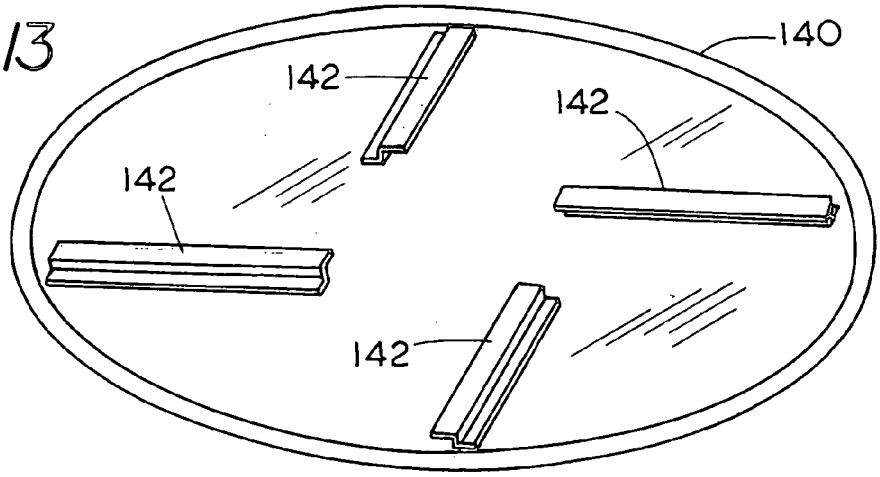
Figure 13A:
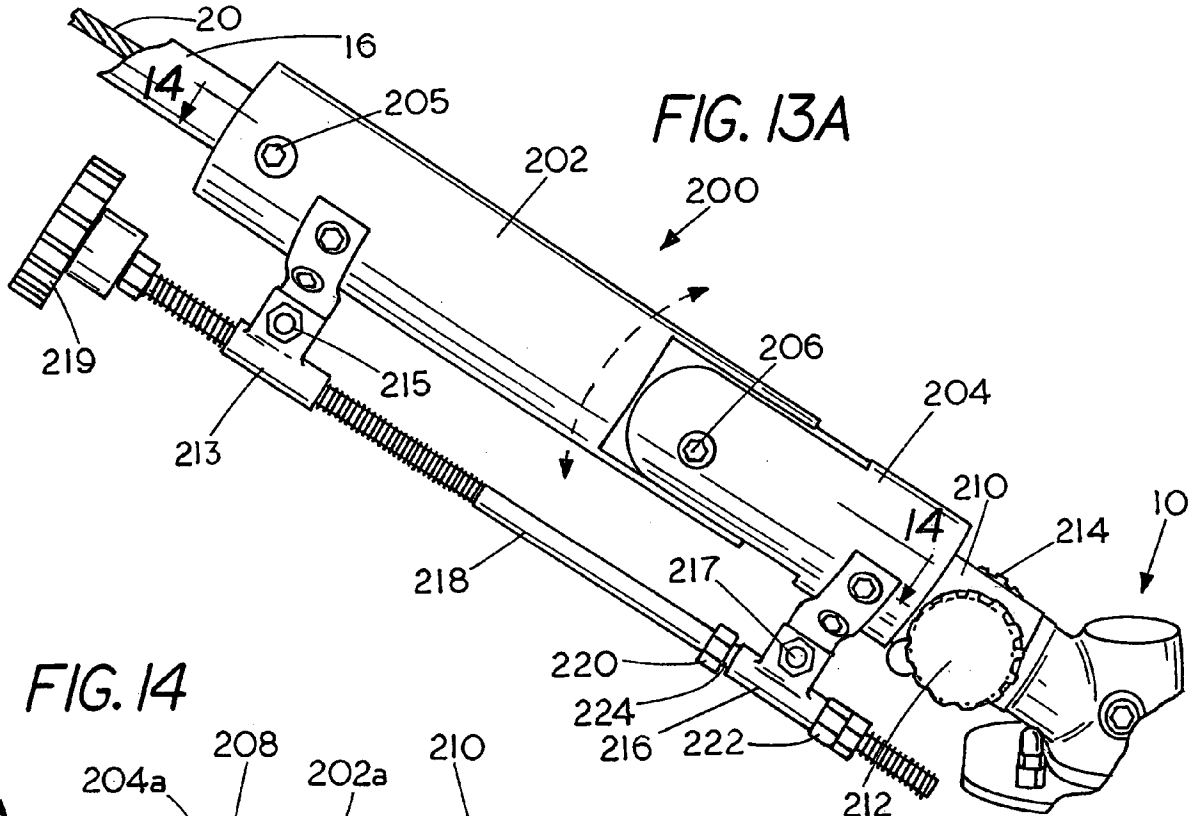
FIG. 13A is a partial side elevational view of the apparatus showing a joint in the handle 16.
Figure 14:
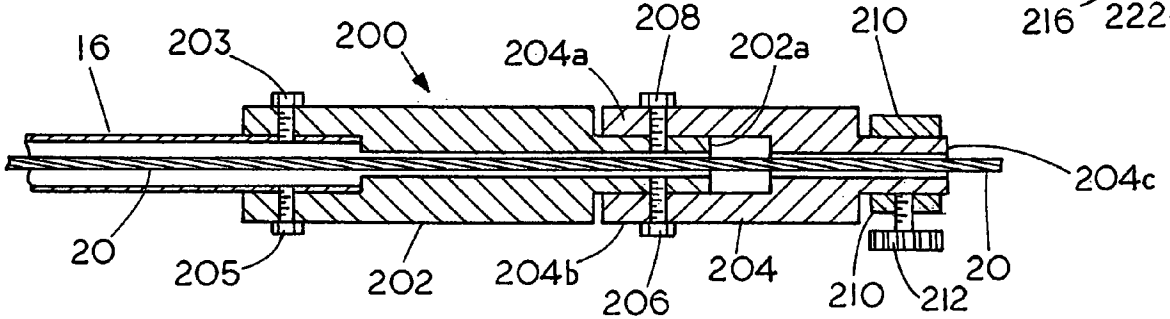
FIG. 14 is a central cross-sectional view taken on line 14—14 of FIG. 13A on a reduced scale.
Figures 15, 16:
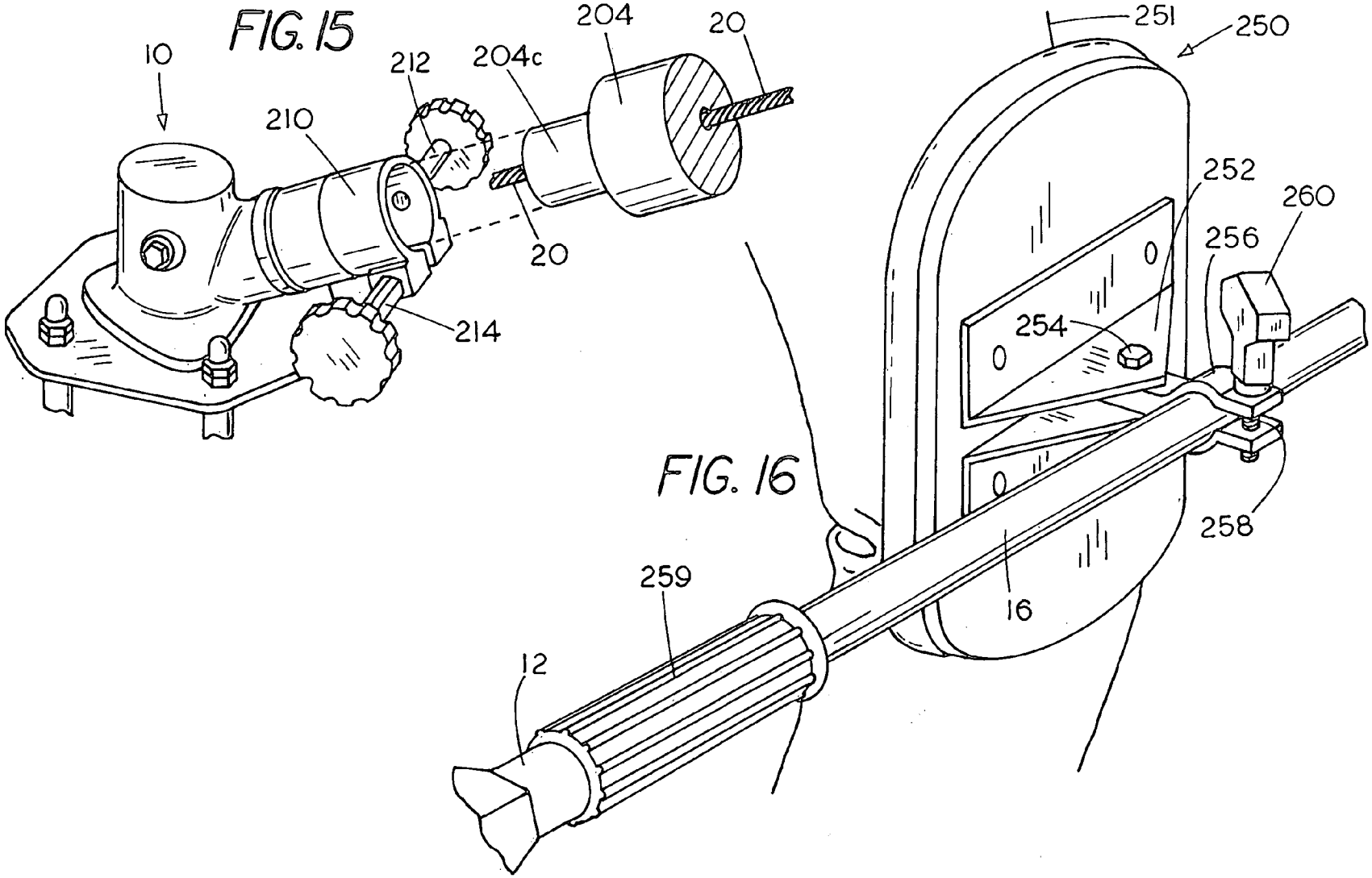
FIG. 15 is a partial exploded perspective view of the lower portion of FIG. 13A as seen from the opposite side on a slightly larger scale
FIG. 16 is a partial perspective view of an upper portion of handle 16 showing a thrust pad as seen from the rear and FIG. 17 is a right side perspective view of another form of blade positioning unit for changing the pitch of the blades.

FIG. 13 shows an optional flat circular finishing disk 140 that can be connected to the blades 36 if desired by means of radially extending retainers 142 which are welded to the upper surface of the finishing disk 140 so that the leading edge of each blade 36 can be slid beneath the leading edge of one of the retainers. The retainers will hold disk 140 in place as the blades rotate during operation.

The invention is a relatively inexpensive and light in weight concrete finisher, typically weighing about 40 pounds that is characterized by having a balanced structure so that by grasping the shaft housing 16 near its center one can lift the entire device since the motor 12 will at least partially counterbalance the weight of the operating head 10. The operating head 10 typically weighs about 31 pounds while the motor 12 and shaft 16 typically weigh about 9 pounds. A heavier motor will provide even better balance. In addition, the much lower profile of the operating head 10 enables it to move under obstructions such as a staircase or other object that is part of the building. Moving the handle 42 enables the operating head to be maneuvered forward or back or left to right as the blades rotate to achieve precise positioning control throughout operation. Moreover, the alignment of the blades 36 directly below the outer edge 66 of the guard ring 64 makes it possible for floors to be finished all the way to the wall so that no manual finishing on hands and knees is required. To change the pitch of the blades 36, the handle 86 can be moved manually so as to shift the control rod either up or down for changing the position of the rotary cams 106, 108, 114 and 116 thereby moving the finishing blades to the desired pitch angle.

The invention described thus far had no provision for accommodating operators of different stature in order to avoid the possibility that some operators might have to stoop while others may find the handle too high. Resisting the lateral force on the handle can also sometimes be tiring. The following FIGS. 13A–17 show a form of the invention that provides added comfort for the operator while the machine is in use and enables the operator to easily control the lateral torque on the handle caused by rotation of the trowel blades without becoming fatigued. A feature is also provided for making incremental changes in the blade angle so that the operator is able to more easily change the blade pitch and is better able to both anticipate and control the degree to which the blade pitch is being changed.

Refer now to FIGS. 13A–15 which show a knee joint 200 comprising two aligned tubular joint members 202 and 204 with interfitting flanges 202*a* and 204*a*, 204*b* connected together by means of aligned pivot pins 206 and 208 that are screw-threaded through the flanges 204*a* and 204*b* and extend into the flange 202*a*. Bolts 203 and 205 connect the knee joint 200 to tube 16. The lower joint member 204 has a tubular extension 204*c* of reduced diameter that is held in a split collar 210 by a threaded retaining pin 212 and a clamp screw 214 which can be loosened to allow the joint member 204 and the rest of the handle 14 to be removed from the operating head 10 for shipment, packaging or storage.

An internally threaded sleeve 213 is connected to the tube 202 and an unthreaded sleeve 216 is connected to the tube 204 by brackets which include pivots 215 and 217 respectively. Extending between the sleeves is a handle height adjustment screw 218 which is screw-threaded into sleeve 213. A knob 219 at the upper end of screw 218 enables the operator to turn the screw 218 in one direction so as to raise the handle 14 about the pivot at 206 or lower it by turning the knob in the other direction. The screw 218 acts as a pivot control for elevating or lowering the free upper end of the handle about the pivot at 206.

An unthreaded portion of the screw 218 that is mounted rotatably within sleeve 216 is held in place by nuts 220 and 222 at the ends of the sleeve 216. The position of the nut 222 is adjustable to provide a small amount of play at 224 such that, say, 1/16 inch play at 224 allows the upper free end of the handle 14 to be raised or lowered 2 inches and 1/8 inch of play allows 4 inches of handle movement, etc. In this way, each operator can adjust both a) the height of the upper end of the handle 14 from the ground, and b) the amount of free handle movement that is allowed in a vertical direction without moving the operating head 10. The adjustment in free play provided by nut 222 thus serves as a restrictor for controlling the arc through which the handle is permitted to move about the pivot at 206. This was found highly effective in making the invention easy to operate with comfort and with a minimum of effort. The play at 224 was found to enable the operator to move his hands up or down slightly without causing the machine to skid to the left or right as it would otherwise do with the blades rotating, thereby providing better control with less fatigue.

Positioned on the side of the handle 14 for placement against the operator's thigh or hip is a thrust pad 250 that has a mounting bracket 252 which is pivotally connected at 254 to a mounting clamp 256 which can be tightened by a screw 258 having a knob 260 at its upper end. When the machine is to be started, the pad 250 can be turned manually in either a forward or a rearward direction about pivot 254 or up and down by loosening the screw 258. This enables the pad 250 to be moved in any direction to suit the operator's needs for placement against the thigh or hip and thereby resist torque caused by rotation of the blades.

Figure 17:
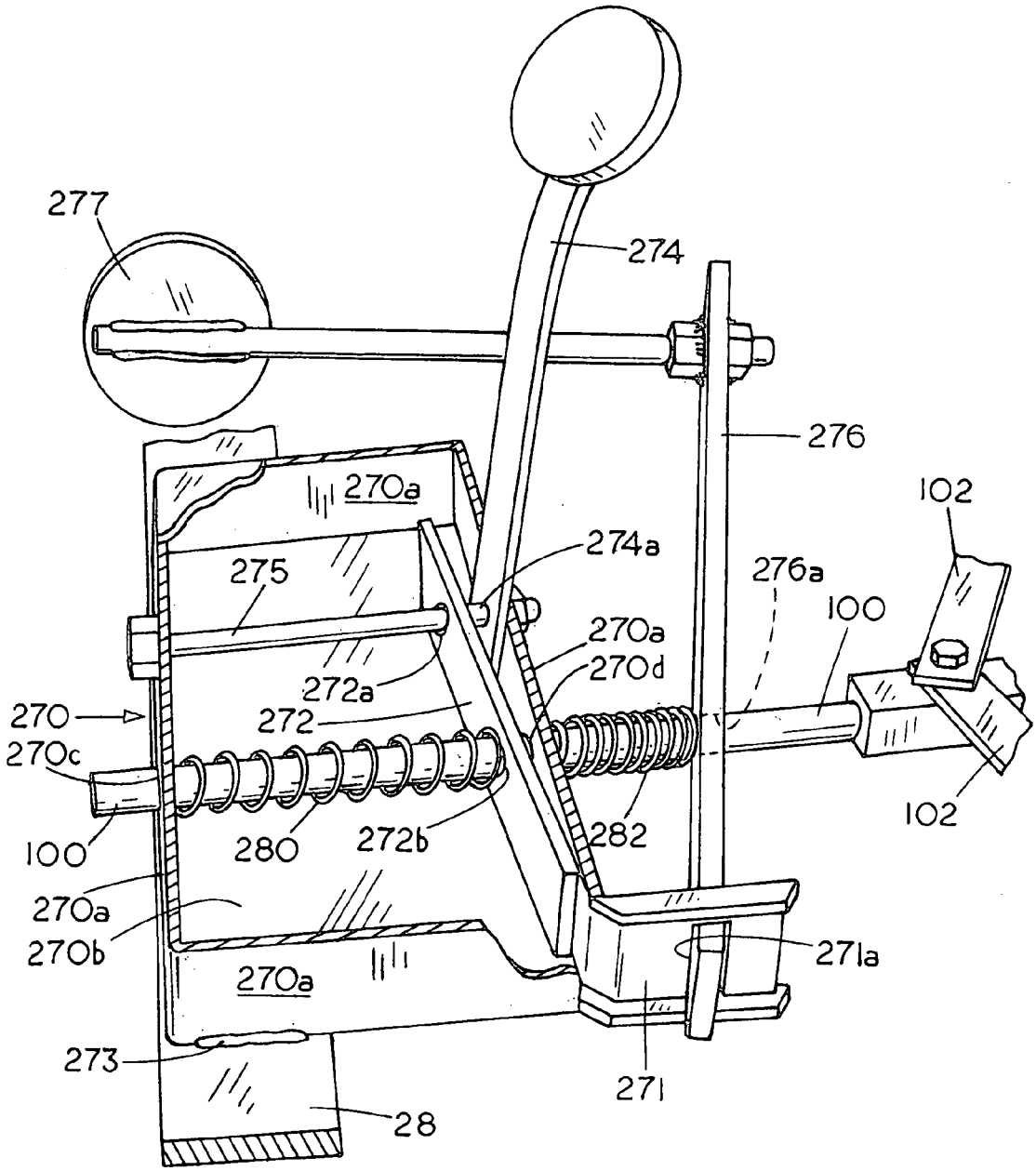

Refer now to FIG. 17 which shows a blade-indexing unit that is used to increase the pitch of the blades incrementally, i.e., to raise the leading edge of the blades in discrete steps rather than continuously as done by the threaded positioning rod 84 previously described. The blade control includes a box-like metal framework 270 having side and end walls 270*a* and a bottom wall 270*b*. Framework 270 is connected to the operating head 10 either with bolts (not shown) or with welding as shown at 273. Extending from one end of the framework 270 to the other, but not connected to it, is a retraction bar or lever 272 having a pair of bored holes 272*a* and 272*b*. Between the far end of the lever 272 and a side wall 270 is an upright retraction pedal 274 having a bored opening 274*a*. A bolt 275 that is secured in place by nuts at each end between opposite side walls 270*a* extends through the openings 272*a* and 274*a* with a loose fit. At one end of the framework 270 is a slotted bracket 271. Extending through a slot 271 a in bracket 271 is a retaining lever 276 having a bored opening 276 for the blade control link which, as shown in FIG. 17, is a rod 100 with a round cross section. The rod 100 has a loose fit in the opening 276*a*. Welded to lever 276 is a release pedal 277. The rod 100 also passes through aligned openings 270*c* and 270*d* in framework 270 and has a loose fit in the opening 272*b* in the retraction lever 272. All the openings are bored to fit the rod 100 loosely. The openings 272*b* and 276*a* in levers 272 and 276 for the rod 100 are both typically about 1/32 inch over the diameter of the rod. Between the framework 270 and lever 272 is a retraction compression spring 280 to force the retraction bar 272 to intersect the rod 100 at an oblique angle. Between the framework 270 and lever 276 is a retaining compression spring 282.

During operation, the blade pitch control rod 100 when retracted to the left in FIG. 17 will elevate the front edges of the trowel blades 30. Retraction is accomplished by repeatedly pressing the upper end of the retraction pedal 274 to the right (and allowing it to return to the left each time) causing it to pivot on the upper edge of the adjacent wall 270*a* thereby forcing the far end of the lever 272 to the left each time the pedal 274 is pressed. The spring 280 forces the edges of the hole 272*b* into wedging engagement with the rod 100 so that the movement of the lever 272 to the left by lever 274 indexes rod 100 repeatedly toward the left in increments of about 1/8 of an inch each time the pedal 274 is pressed to progressively elevate the leading edge of the trowel blades in discrete steps. The operator will know by experience about what effect depressing the pedal 274 three times or a dozen times will have on the action of the blades. Thus, the pitch changes are easy to make and the degree to which the pedal changes the pitch can be controlled and anticipated. To change the pitch back to zero, the operator depresses the release pedal by moving it toward the viewer in FIG. 17 compressing spring 282 and thereby freeing the rod which is wedged in the opening 276*a* by a spring 282 thus allowing the weight of the operating head 10 to move the rod 100 all the way back to the right in FIG. 17 so as to rotate the cams 106, 108, 114, and 116 back to their starting positions and thus allowing the blades to lie flat on the concrete.

Many variations of the present invention within the scope of the appended claims will be apparent to those skilled in the art once the principles described herein are understood.

What is claimed is:

1. A rotary concrete finishing trowel comprising, an operating head at one end of the apparatus having a blade shaft rotatably mounted thereon with at least one concrete finishing blade connected thereto for finishing a concrete floor surface, a drive motor at the other end of said apparatus, an elongated frame element connected at one end to the drive motor and at the other end to the operating head, a drive shaft extending between the motor and the operating head for imparting rotation to the shaft for rotating the finishing blade and said elongated frame element has a knee joint therein that includes a laterally extending pivot for permitting a free upper end of the elongated frame element to pivot about said knee joint in a vertical direction.

2. The apparatus of claim 1 including a pivot control for regulating the elevating or lowering of an upper free end of the elongated frame element about said pivot.

3. The apparatus of claim 2 wherein a restrictor is operatively associated with the pivot for limiting an arc through which the elongated frame element is permitted to move about said pivot.

4. The apparatus of claim 1 wherein the pivot includes a pair of laterally extending aligned pivots on opposite sides of the drive shaft.

5. The apparatus of claim 1 wherein the knee joint comprises a pair of elements having laterally aligned flanges with at least one horizontal pivot pin extending between the flanges to define the pivot.

6. The apparatus of claim 1 wherein the knee joint comprises a pair of elements including a pair of longitudinally extending flanges on one element, a centrally located flange on a second said element and a pivot pin extending between the centrally located flange and each of the other flanges.

7. The apparatus of claim 1 including a thrust pad that has at least one pivot for repositioning the pad to face toward a forward or rearward or an upper or lower part of said apparatus.

8. The apparatus of claim 7 wherein the thrust pad includes a first pivot for pivoting the pad toward a front or rear portion of the apparatus and a second pivot for elevating or lowering the pad.

9. The apparatus of claim 8 wherein the second pivot comprises a clamp for releasably connecting the pad to the frame element.

10. The apparatus of claim 1 wherein each such blade is mounted for pivotal movement on a horizontal radially extending axis, a position control member is operatively connected to each such blade for changing the pitch of each finishing blade around said horizontal radial axis and said position control member is mounted upon the apparatus for being moved by an operator to incrementally index the control member in a given direction to change the pitch of said blade in discrete steps.

11. The apparatus of claim 10 wherein the position control member is an elevating rod that is connected to a retraction bar having a hole therein through which the elevating rod passes and a spring is positioned to force the retraction bar to intersect the rod at an oblique angle such that the edges of the hole engage the rod with a wedging action for causing the rod to move in said given direction when the retraction bar is indexed repeatedly to thereby progressively elevate the leading edge of the blades in discrete steps.

12. The apparatus of claim 11 wherein a retraction pedal is pivotally mounted on the apparatus and is operatively associated with the retraction bar for repeatedly moving the retraction bar for progressively elevating a leading edge of each such blade.

13. The apparatus of claim 11 including a release lever operatively connected to the rod for normally permitting one-way movement of the rod in said given direction and for being moved to a releasing position to allow the rod to move in an opposite direction.

* * * * *